United States Patent [19]

Kondo et al.

[11] 4,080,158

[45] Mar. 21, 1978

[54] HEAT-FIXING DEVICE

[75] Inventors: Eiichi Kondo, Kawasaki; Takao Aoki, Abiko; Shigeyoshi Onoda, Kawasaki, all of Japan

[73] Assignee: Canon Kabushiki Kaisha, Tokyo, Japan

[21] Appl. No.: 781,505

[22] Filed: Mar. 25, 1977

Related U.S. Application Data

[63] Continuation of Ser. No. 629,671, Nov. 6, 1975, abandoned.

[30] Foreign Application Priority Data

Nov. 11, 1974 Japan ..... 49-129754

[51] Int. Cl.[2] ..... G03G 15/20

[52] U.S. Cl. ..... 432/59; 432/8; 432/45; 219/216; 198/689

[58] Field of Search ..... 432/59, 60, 227, 228, 432/8, 45; 355/3 FU; 219/216, 469, 388; 271/197, 265; 198/689; 34/41, 48, 155

[56] References Cited

U.S. PATENT DOCUMENTS

| | | | |
|---|---|---|---|
| 3,123,354 | 3/1964 | Ungerer | 271/197 |
| 3,398,259 | 8/1968 | Tregany et al. | 219/216 |
| 3,452,181 | 6/1969 | Stryjewski | 432/59 |
| 3,498,592 | 3/1970 | Moser et al. | 432/59 |
| 3,517,164 | 6/1970 | Huggins et al. | 219/216 |
| 3,659,840 | 5/1972 | Ruck | 271/197 |
| 3,697,722 | 10/1972 | Furuichi et al. | 219/216 |
| 3,781,517 | 12/1973 | Skamra | 432/59 |
| 3,823,937 | 7/1974 | Hirafuji | 271/197 |
| 3,826,892 | 7/1974 | Draugelis et al. | 219/216 |
| 3,863,913 | 2/1975 | Hirafuji | 271/265 |
| 3,909,613 | 9/1975 | Critchlow | 250/316 |

*Primary Examiner*—John J. Camby
*Assistant Examiner*—Henry C. Yuen
*Attorney, Agent, or Firm*—Fitzpatrick, Cella, Harper & Scinto

[57] ABSTRACT

In a heat-fixing device for fixing a member to be fixed as it is conveyed on a conveyance path provided with a heat source, there is provided suction means having a suction port adjacent to the conveyance path. The suction means is operable to draw the member to be fixed as it is conveyed.

25 Claims, 5 Drawing Figures

HEAT-FIXING DEVICE

This is a continuation of application Ser. No. 629,671, filed Nov. 6, 1975, now abandoned.

BACKGROUND OF THE INVENTION

1. Field of the Invention

This invention relates to a heat-fixing device for use in electrophotographic copying machines, and more particularly to such a device which prevents jamming of a member to be fixed during the conveyance thereof to thereby enable good conveyance and heat-fixation of the member to be achieved.

2. Description of the Prior Art

The devices for heat-fixing copy mediums by the use of radiant heat sources have heretofore been widely in use. With such devices, however, the copy medium when conveyed by conventional coveyor means such as belts or rollers has often been snagged on a projection or the like along the conveyance path due to the curling of the copy medium resulting from the heating and this has caused oblique movement of the copy medium which might possibly have resulted in jamming of the copy medium. Occurrence of such jamming could cause such an accident as burning or firing of the copy medium which has been undesirable in practice.

SUMMARY OF THE INVENTION

In view of the above-noted disadvantages, the present invention provides a device which can achieve good heat-fixation without giving rise to jamming.

The present invention also provides a heat-fixing device in which a heat source is provided on the conveyance path and conveyor means for conveying members to be fixed is provided with suction means having a plurality of openings, whereby only those of the suction openings which are covered by the member to be fixed are operable to effect the suction.

The present invention further provides a heat-fixing device in which individually controllable suction ports or suction port groups are arranged along the direction of movement on the conveyance path so that at least one of the suction ports or suction port groups covered by the member to be fixed is operable to effect the suction.

The present invention also provides a heat-fixing device in which detector means for detecting the passage of the member to be fixed are provided forwardly and rearwardly of the individually controllable suction ports or suction port groups so that the suction is controlled in accordance with the detection by each of the detector means.

The invention will become more fully apparent from the following detailed description thereof taken in conjunction with the accompanying drawings.

DESCRIPTION OF THE PREFERRED EMBODIMENTS

Figure 1:
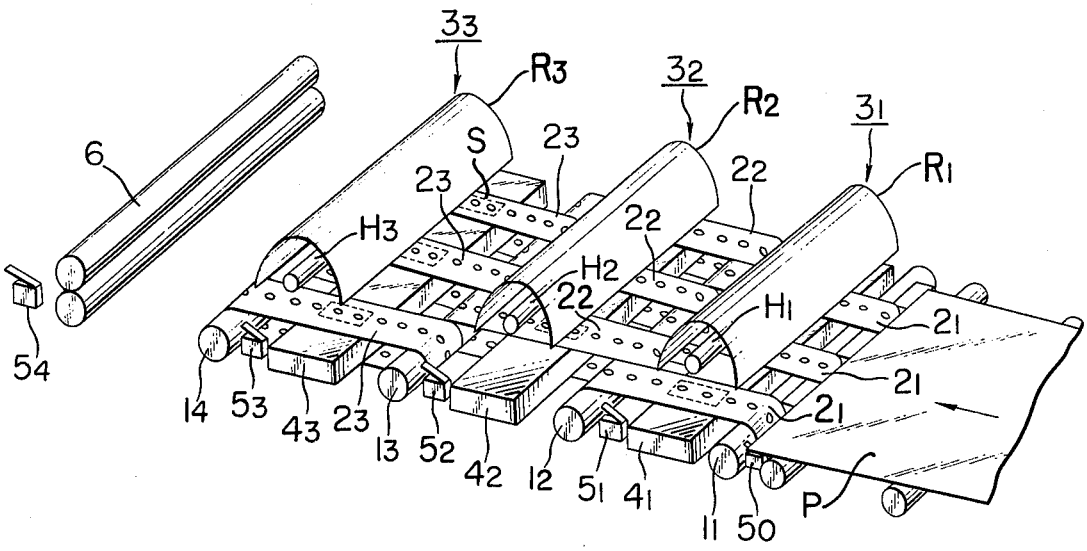
FIG. 1 is a perspective view illustrating an embodiment of the device according to the present invention.

Details of the present invention will hereinafter be described with respect to some specific embodiments thereof shown in the drawings.

FIG. 1 illustrates an embodiment of the device according to the present invention. There is at least one set of conveyor rollers $\mathbf{1}_1$, $\mathbf{1}_2$, etc. over which are stretched conveyor belts $\mathbf{2}_1$, $\mathbf{2}_2$, etc. The conveyor belts $\mathbf{2}_1$, $\mathbf{2}_2$, etc. may be moved by rotation of the conveyor rollers which are driven from an unshown drive source. The conveyor belts are formed with rows of openings arranged at a predetermined interval in the direction of movement.

Sets of heat sources $\mathbf{3}_1$, $\mathbf{3}_2$, etc. are provided above the conveyor belts and may comprise, for example, nichrome wire heaters $H_1$, $H_2$, etc. and reflector shades $R_1$, $R_2$, etc.

Sets of suction ducts are provided on the back side of the conveyor belts which is opposite to the side which faces the heat sources. The suction ducts have slots S (indicated by broken lines) formed in parallel to the direction of movement of the belts for effecting the suction. Detector elements, such as microswitches, $\mathbf{5}_1$, $\mathbf{5}_2$, etc. for detecting the arrival of a member P to be fixed are provided at predetermined positions on the respective ducts to control the suction of the ducts (usually, the leading end detecting position which is concerned with activation of the ducts is located before each duct, and the trailing end detecting position which is concerned with deactivation of the ducts is located after each duct).

Figure 2:
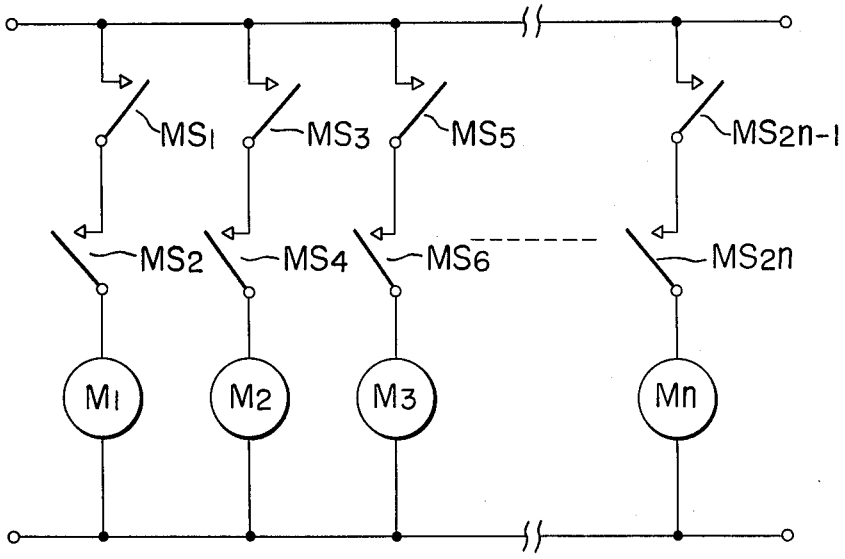
FIG. 2 is a diagram showing a specific example of the control circuit.

FIG. 2 shows an example of the control circuit in which microswitches are employed.

The microswitch MS1 disposed before the first suction duct and the microswitch MS2 disposed past the first duct are series-connected to each other on the NO side and connected to a duct fan motor M1. This is also the case with the second and subsequent suction ducts. As viewed in the arrangement shown in FIG. 1, the detector element $\mathbf{5}_0$ corresponds to MS1 and the subsequent detector elements $\mathbf{5}_1$ and so on correspond to MS2, MS4, etc., thus forming an arrangement of double-throw microswitches.

With such an arrangement, the microswitch MS1 is closed when the member to be fixed which may be a sheet of plain paper with electrophotographic toner particles deposited thereon comes to the first suction duct, and then the microswitch MS2 is closed by the leading end edge of the member to thereby energize the fan motor M1. Thus, the member is drawn to the belts so as to be positively conveyed. Likewise, at the second and subsequent suction ducts, their respective fan motors will be energized. Next, when the member is further conveyed and the trailing end edge thereof comes to the first suction duct, the microswitch MS1 is opened to deenergize the fan motor M1. Likewise, at the second suction duct, the microswitch MS3 is opened upon arrival of the trailing end edge of the member, thereby deenergizing the fan motor M2. In this manner, the suction fan motors are successively deenergized upon passage of the member so that the member to be fixed undergoes the fixation and is discharged out of the machine. Since the suction ducts are thus driven successively with movement of the member to be fixed and are deactivated upon passage of the trailing end edge of the member, both the fixation and the conveyance of the member to be fixed may be achieved efficiently without the necessity of reducing the fixing temperature within the fixing device.

If, unlike the above-described control circuit, not all of the fan motors need be energized during the passage of the member to be fixed, it will be apparent that suitable modifications may be made, including a design for changing over the suction fans in succession.

Figure 3:
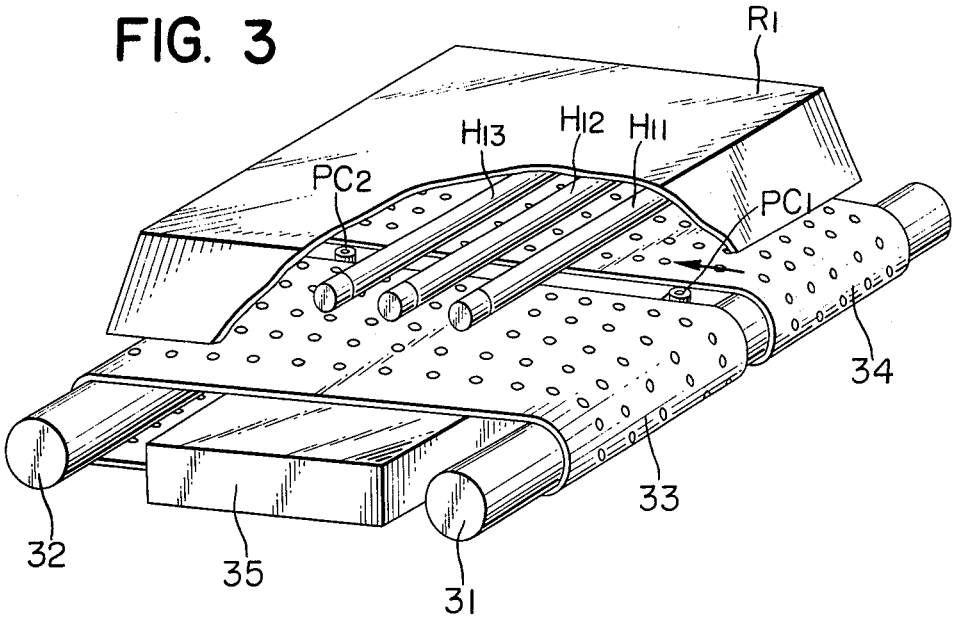
FIG. 3 is a perspective view illustrating another embodiment of the device according to the present invention.
Figure 3A:
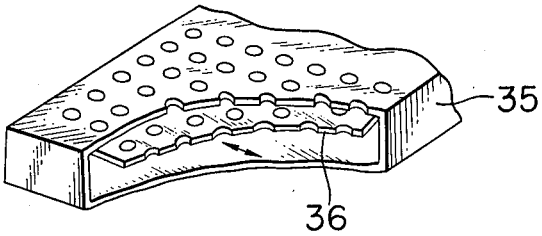
FIG. 3*a* shows a fragmentary view illustrating the duct section.

FIG. 3 illustrates a further embodiment of the device according to the present invention.

In the embodiment described just above, the suction of the suction ducts is controlled by ON-OFF of the suction fan motors, whereas in the present embodiment, valves are provided to the openings formed in ducts and either the microswitches as will be described or photocells PC1 and PC2 are provided to detect the member to be fixed, whereby the valves are opened and closed. As in the previous embodiment, conveyor belts 33 and 34 are stretched over and between conveyor rollers 31 and 32 and formed with a number of openings and duct 35 is formed with suction ports corresponding to those openings, but valves 36 are provided which can block the suction ports of the suction duct (these valves are shown as comprising a movable plate formed with openings).

The heat source is provided by a parallel arrangement of tungsten lamps $H_{11}$, $H_{12}$, etc. which are temperature-controlled under a reflection factor $R_1$, and photocells PC1 and PC2 are disposed at the positions as between the conveyor belts 33 and 34 whereat the light from the lamps may be intercepted by the image transfer medium as it arrives there. These photocells may advantageously have a sensitivity to the infrared range, since no particular light source is then required.

With this arrangement, the suction duct is activated upon interception of light at PC2 and deactivated upon detection of light at PC1. If such a design is made that an ON signal is produced when both PC1 and PC2 are shielded against light and that an OFF signal is produced when PC1 has detected light, then the control of the suction port will be more reliable. The driving of the valves may be effected as by operation of a solenoid energizable in response to the detection signal.

On the other hand, it will be apparent that a good relationship between the member to be fixed and the operation of the valves may be provided by activating the valves in plural suction ducts successively upon detection of the leading edge of the member and deactivating them successively upon detection of the trailing end edge of the member, in a manner similar to that described in connection with the previous embodiment.

Where discharge rollers 6 are provided as shown, the operation may be continued until the leading end edge of the member to be fixed is nipped between these rollers, whereupon the operation may be stopped. This holds true of the device of the previous embodiment.

Figure 4:
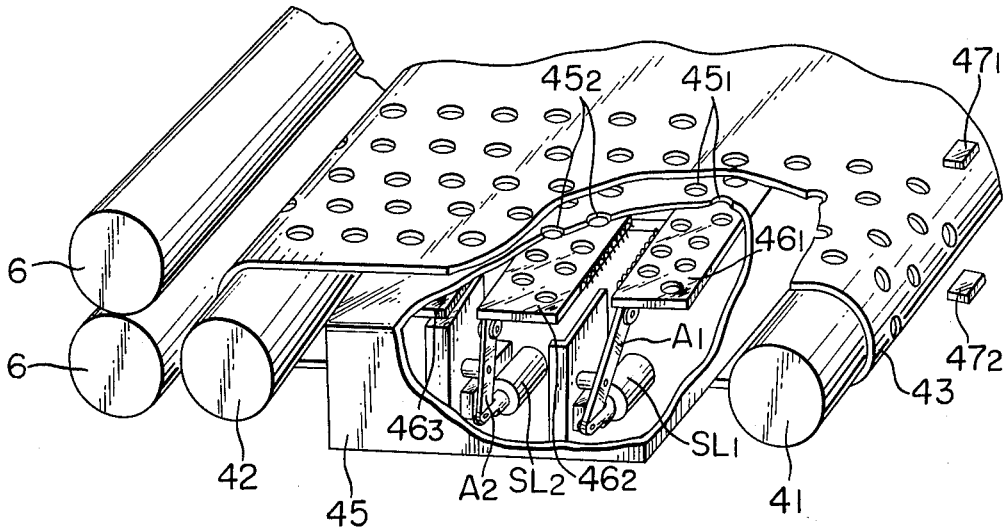
FIG. 4 is a perspective view illustrating still another embodiment of the present invention.

FIG. 4 illustrates still a further embodiment of the device. Suction duct 45 is disposed on the underside of the heat source so as to occupy a sufficient area and the duct is formed with suction ports $45_1$, $45_2$, etc. arranged in parallel rows along an axis perpendicular to the direction of movement of the member to be fixed, and individually controllable valves $46_1$, $46_2$, etc. are provided for each of the rows.

A detector element such as ultrasonic oscillator $47_1$ disposed at the entrance to the heat-fixing device and an associated reception element $47_2$ are cooperable with each other to detect the entry of the member to be fixed and produce a detection signal, in response to which a program control mechanism is energized to produce a program control signal, which in turn energizes selenoids SL1 and SL2 to move arms A1, A2, etc., thus opening and closing the valves in succession.

As an example, the program control may sufficiently effectively be designed such that energization is caused to take place in succession with a predetermined retardation by time limit means from entry of the detection signal till the actuation of the valves and that the hold means for each valve releases in a predetermined time after the actuation of the valves.

The release signal may of course be produced by the time limit means in response to the detection signal.

On the other hand, it will also be effective if it is arranged that the holding time of the hold means may be changed in accordance with the variable length of the member to be fixed.

As described above with respect to some specific embodiments, the member to be fixed is conveyed beneath the heat source while being drawn into intimate contact with the conveyor means and this eliminates irregular movement of the member on the path of conveyance and also reduces the possibility of snagging the member. Even if there is a slight possibility of snapping the irregular movement is eliminated and thus, the possibility of jamming may be sufficiently eliminated in either event.

Moreover, the suction takes place only in the area where the member to be fixed is present and this leads to the elimination of wasteful discharge of the heat from without the heat-fixing device which might possibly reduce the temperature within the device and accordingly the efficiency thereof, and good fixation may thus be ensured.

From what has been disclosed hereinabove, it will be readily apparent to those skilled in the art that many other modifications and/or additions may be made to the device described above, and it is intended that these be covered by the present invention as disclosed herein and as defined in the appended claims.

What is claimed is:

1. A device for fixing a sheet member having an image formed on the surface thereof comprising:

at least one endless belt extending along a conveying path of the sheet member, said endless belt being formed with a plurality of apertures;

means for driving said endless belt;

means formed with a plurality of suction ports for suctioning the air along the conveying path through said apertures and through said suction ports to thereby attract the sheet member toward the surface of said endless belt;

means positioned along said path for heating the sheet member conveyed by said endless belt; and means responsive to the position of the member along said path for controlling the air suctioning means to suction air only through the apertures which are covered by the sheet member as the member is conveyed along said path by sequentially permitting suction through suction ports adjacent the covered apertures while preventing suction through the suction ports adjacent to the apertures not covered by the member.

2. A device according to claim 1, wherein said suction means includes a suction box formed with said plurality of suction ports facing the conveying path and means for removing air from said suction box and wherein said control means includes means for detecting the position of the sheet member and means for selectively closing and opening the suction box ports in accordance with an output from said detecting means.

3. A heating-fixing device comprising:

means for conveying a member to be fixed along a path;

means positioned along said path for heating a predetermined area of said path;

means for removing air from between said conveying means and the member to thereby attract the member to said conveying means; and means controlling said air removing means to remove air only within said area heated by said heating means and only between said conveying means and the member;

wherein said control means includes means disposed at the entrance and at the exit of said area, respectively, for detecting the member, and wherein said air removing means is actuated when the detecting means at the entance and at the exit both detect the member.

4. A device according to claim 3, wherein said air removing means includes a withdrawal box formed with a plurality of apertures, means for withdrawing air from said withdrawal box and means for selectively opening and closing the apertures of said withdrawal box in response to said control means to thereby actuate or deactuate said air removing means.

5. A heat-fixing device according to claim 4, wherein said control means fails to actuate said air removing means when only one of said detecting means detects the member.

6. A device for conveying a sheet member through a heating area comprising:

an endless belt formed with a plurality of apertures and extending along the heating area;

a plurality of rollers drivably supporting said endless belt;

a plurality of suction boxes disposed adjacent to said endless belt and arranged along the conveying path of the sheet member, said suction boxes having further apertures formed therein in the vicinity of the conveying path of the sheet member; and means for controlling each of said suction boxes to apply suction only to the apertures on which the sheet member is placed;

wherein said control means includes means for detecting the sheet member and wherein said suction boxes are actuated successively in accordance with an output from said detecting means.

7. A heat-fixing device comprising:

means for conveying a member to be fixed along a path, means positioned along said path for heating a predetermined area of said path;

means adjacent to said heating means and formed with a plurality of suction ports for removing air from between said conveying means and the member to thereby attract the member to said conveying means; and means responsive to the position of the member for controlling said air removing means to sequentially remove air only through said suction ports covered by the member while preventing the removal of air through the suction ports not covered by the member as the member is conveyed along said path.

8. A heat-fixing device according to claim 7, further comprising means for discharging the member from the device and wherein said control means deactivates said air removing means as the member arrives at the discharge means.

9. A device according to claim 7, wherein said air removing means includes a withdrawal box formed with said plurality of suction ports, means for withdrawing air from said withdrawal box and means for selectively opening and closing the suction box ports in response to said control means.

10. A device according to claim 9, wherein said control means includes means for detecting the member and means operating said opening and closing means in timed sequence in response to a detection signal from said detecting means.

11. A heat-fixing device according to claim 7, in which said control means includes means for detecting the member and means for operating said air removing means for a predetermined period in response to an output from said detecting means.

12. A heat-fixing device according to claim 7, wherein said member is a sheet material having a toner image formed thereon and wherein said heating means has a heat source to heat the toner image by radiant heating.

13. A heat-fixing device according to claim 12, wherein said heat source is a tungsten lamp spaced from said conveying means, the conveyance path extending therebetween.

14. A heat-fixing device according to claim 7, wherein said control means actuates said air removing means as the leading edge of the member is proximate to the exit end of said area heated by said heating means.

15. A heat-fixing device according to claim 7, wherein said control means deactivates said air removing means as the rear edge of the member is proximate to the entrance end of said area heated by said heating means.

16. A heat-fixing device according to claim 7, wherein said conveying means and said heating means are spaced from each other to define the conveyance path therebetween.

17. A device for fixing a sheet member having an image formed on the surface thereof comprising:

at least one endless belt disposed along a path for conveying the sheet member, said endless belt being formed with a plurality of apertures;

means for driving said endless belt;

a plurality of means adjacent to said endless belt for suctioning air along the conveying path through said apertures for attaining the sheet member toward the surface of said endless belt, the plurality of air suctioning means being arranged in an array along the conveying path of the sheet member, each of said air suctioning means being actuatable independently from each other;

a plurality of means positioned along the conveying path for heating the sheet member conveyed by said endless belt, the number of heating means corresponding to the number of air suctioning means; and means responsive to the position of the sheet member for sequentially actuating each air suctioning means when the adjacent apertures are covered by the sheet member while preventing the actuation of any air suctioning means adjacent to apertures not covered by the sheet member so that air is suctioned only through the apertures covered by said sheet member.

18. A device for fixing a sheet member having an image formed on the surface thereof comprising:

at least one endless belt formed with a plurality of apertures and extending along a path for conveying the sheet member;

a plurality of means for suctioning the air about the conveying path through said apertures, each of said air suctioning means being independently actuatable;

means disposed along the conveying path for heating the sheet member conveyed by said endless belt; and means for sequentially actuating each of said air suctioning means in response to the position of the sheet member to suction air only through the apertures covered by said member as said member is conveyed along said path while said actuating means prevents suction through the apertures not covered by said member.

19. A device for conveying a sheet member through a heating area comprising:

an endless belt formed with a plurality of apertures and extending through the heating area;

means for driving said endless belt;

means formed with a plurality of suction ports for applying suction to the apertures of said endless belt to attract the sheet member toward the surface of said endless belt; and means responsive to the position of the sheet member for controlling said suctioning means to apply suction only to the apertures covered by the sheet member by sequentially permitting suction through suction ports adjacent the covered apertures while preventing suction through the suction ports adjacent to apertures not covered by the member.

20. A device according to claim 19, wherein said control means activates the suctioning means as the leading edge of the sheet member is proximate to the exit of the heating area.

21. A device according to claim 19, wherein said control means deactivates the suctioning means as the rear edge of the sheet member is proximate to the inlet to the heating area.

22. A device according to clalim 19, wherein said suctioning means includes a suction box having said plurality of suction ports facing the endless belt and means for removing air from said suction box.

23. A device for conveying a sheet member through a heating area comprising:

an endless belt formed with a plurality of apertures and extending along the heating area;

a plurality of rollers drivably supporting said endless belt;

a plurality of suction boxes disposed adjacent to said endless belt and arranged along the conveying path of the sheet member, said suction boxes each having a plurality of suction ports formed therein in the vicinity of the conveying path of the sheet member; and means responsive to the position of the sheet member for sequentially controlling each of said suction boxes to apply suction only when the adjacent apertures are covered by the sheet member while preventing the application of suction by the suction boxes adjacent to the apertures not covered by the sheet member.

24. A device for conveying a sheet member through a heating area comprising:

a plurality of endless belts extending along the heating area;

a plurality of rollers drivingly supporting said endless belts;

means for attracting the sheet member toward the surface of said endless belts, the attracting means including a suction box having a plurality of apertures facing the conveying path of the sheet member; and means responsive to the position of the sheet member for controlling the suction box to sequentially apply suction only to the apertures covered by said sheet member while said control means prevents the application of suction to the apertures not covered by said sheet member.

25. A fixing device in an electrophotographic copying machine comprising:

means for conveying a supporting member formed with a toner image along a path;

a heating means disposed adjacent to the path along which the support member is conveyed;

suction means facing the heating means to apply suction through a plurality of apertures disposed along the path and operatively connected to said suction means; and means responsive to the position of the supporting member for controlling said suction means to sequentially apply suction only to the apertures covered by the supporting member while said control means prevents the application of suction to the apertures not covered by the supporting member.

* * * * *

UNITED STATES PATENT AND TRADEMARK OFFICE

CERTIFICATE OF CORRECTION

PATENT NO. : 4,080,158

DATED : March 21, 1978

INVENTOR(S) : Eiichi Kondo, et al.

It is certified that error appears in the above-identified patent and that said Letters Patent are hereby corrected as shown below:

Col. 1, line 19, change "coveyor" to --conveyor--.

Col. 6, line 54, Claim 17, change "attaining" to --attracting--.

Col. 7, line 50, Claim 22, change "clalim" to --claim--.

Col. 8, line 42, Claim 25, change "support" to supporting--.

Signed and Sealed this

*First* Day of *August 1978*

[SEAL]

*Attest:*

RUTH C. MASON
*Attesting Officer*

DONALD W. BANNER
*Commissioner of Patents and Trademarks*